United States Patent [19]

Tanaka et al.

[11] Patent Number: 4,972,234

[45] Date of Patent: Nov. 20, 1990

[54] ENDLESS BELT WITH RECESS FOR RECEIVING SHEET FEEDING GRIPPERS

[75] Inventors: Nobuyuki Tanaka, Atsugi; Hiroyuki Inoue, Kawasaki, both of Japan

[73] Assignee: Fujitsu Limited, Kawasaki, Japan

[21] Appl. No.: 480,684

[22] Filed: Feb. 15, 1990

[30] Foreign Application Priority Data

Feb. 17, 1989 [JP] Japan ..... 1-36297
Oct. 25, 1989 [JP] Japan ..... 1-277710

[51] Int. Cl.[5] ..... G03G 21/00

[52] U.S. Cl. ..... 355/309; 198/470.1; 198/721; 271/204; 271/277; 355/312

[58] Field of Search ..... 355/312, 309, 308, 212; 271/204, 206, 277; 198/470.1, 721

[56] References Cited

U.S. PATENT DOCUMENTS 3,853,315 12/1974 Dahlgren ..... 271/204
4,135,808 1/1979 Morrison ..... 355/312
4,203,590 5/1980 Blessing ..... 271/204 X
4,276,978 7/1981 Deguchi et al. ..... 271/204 X
4,799,664 1/1989 Burger ..... 271/204 X

FOREIGN PATENT DOCUMENTS 62-145262 6/1987 Japan .

*Primary Examiner*—A. T. Grimley
*Assistant Examiner*—William J. Royer
*Attorney, Agent, or Firm*—Armstrong, Nikaido, Marmelstein, Kubovcik & Murray

[57] ABSTRACT

An apparatus for feeding a printing sheet in a printer, including a gripper feeding belt for carrying grippers which grip a leading end of the printing sheet to feed it along a horizontal sheet feeding path; a plurality of toner printing units used for printing, in turn, colors of yellow (Y), magenta (M), cyan (C), and black (B), and arranged in series, at which a toner image is transferred to the printing sheet; and a plurality of sheet supporting belts arranged between the toner printing units to support the printing sheet in a horizontal state. The sheet supporting belt has at least one recess for receiving the gripper and is driven in synchronization with the grippers.

17 Claims, 8 Drawing Sheets

$Vg \geq Vb$

ENDLESS BELT WITH RECESS FOR RECEIVING SHEET FEEDING GRIPPERS

BACKGROUND OF THE INVENTION

1. Field of the Invention

This invention relates to a printer, and more particularly, to an apparatus for feeding a printing media, such as a printing sheet or paper, to a printer having a plurality of toner printing units arranged along a feeding path of the printing sheet to transfer, in turn, color images of yellow (Y), magenta (M), cyan (C), and black (B), respectively, to the printing sheet.

2. Description of the Related Art

A printer including a plurality of toner printing units, such as used for printing, in turn, various colors, for example, yellow (Y), magenta (M), cyan (C), and black (B), respectively, arranged along a feeding path of the printing sheet to obtain a full color image on the printing sheet is known, and such a printer is disclosed, for example, in Japanese Unexamined Patent Publication (Kokai) No. 62-145262, in which a plurality of toner printing units are arranged along a sheet feeding path. Each of the toner printing units comprises a rotatable photoconductor drum, and around this photoconductor drum are arranged, in turn, an charger unit for charging the photoconductor drum, an optical depositing unit for forming a latent image on the photoconductor drum, a developing unit for changing the latent image to a toner image, a transferring unit for transferring the toner image on the photoconductor drum onto the printing sheet, and a cleaner for removing remaining toner from the photoconductor drum. The printing sheet is fed along a horizontal sheet feeding path by grippers mounted on a gripper feeding chain for gripping a leading edge of the printing sheet, and a plurality of air suction belts are arranged between the toner printing units to support the printing sheet in a horizontal state when the printing sheet is fed in the feeding direction.

In such a sheet feeding apparatus known in the prior art, however, the air suction belts must be arranged lower than the photoconductor drum by at least a thickness of the grippers. Therefore, the printing sheet may be easily bent or deformed while it is fed along the sheet feeding path. Namely, an exact horizontal state of the printing sheet cannot be guaranteed, and thus the transferring or printing positions of the printing sheet do always coincide in the respective toner printing units.

SUMMARY OF THE INVENTION

An object of the present invention is to provide an apparatus for feeding a printing sheet of a printer having a plurality of toner printing units arranged in series along a sheet feeding path, and capable of avoiding any bending or deformation of the printing sheet and of stably supporting the printing sheet in a horizontal state.

Another object of the present invention is to provide such an apparatus for feeding a printing sheet of a printer, and capable of transferring or printing in exactly the same way and same position on the printing sheet.

According to the present invention, there is provided an apparatus for feeding a printing sheet in a printer comprising: a first endless belt or chain assembly for carrying grippers equidistantly mounted thereon for gripping a leading end of the printing sheet to feed same along a substantially horizontal sheet feeding path; a plurality of toner printing units arranged in series along said sheet feeding path so that, when the printing sheet passes through each of said toner printing units, a toner image is transferred to the printing sheet; a plurality of second belt assemblies, each arranged between said toner printing units along said sheet feeding path and comprising at least one second endless belt having a substantially horizontal sheet feeding portion, which is located at substantially the same level as said grippers, for supporting the printing sheet in a substantially horizontal state thereof; and said second endless belt having at least one recess for receiving said gripper.

In this invention, the second endless belt assemblies are driven in synchronization with the first endless belt assemblies, in such a manner that the grippers are received, in turn, in the recess of the second endless belt assemblies. Therefore, no interference by the second endless belt assemblies of the grippers when supporting the printing sheet in the horizontal state occurs, and thus the second endless belt assemblies can be arranged at the same level as a lower portion of the photoconductor drum.

Accordingly, the printing sheet is kept exactly in the horizontal state without any bending or deformation thereof, so that the transferring or printing positions are exactly the same throughout the respective toner printing units.

DESCRIPTION OF THE PREFERRED EMBODIMENTS

Figure 1:
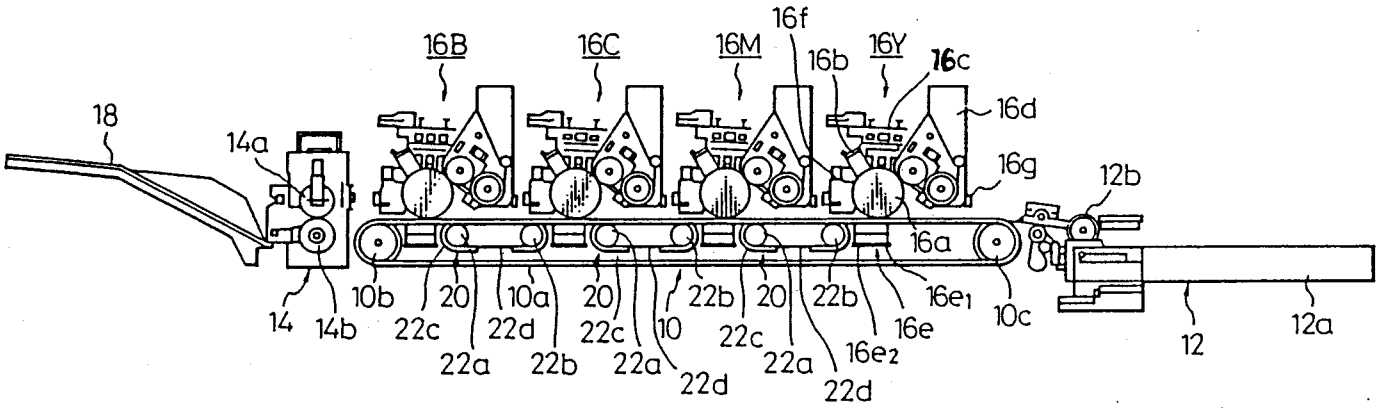
FIG. 1 is a front view illustrating a color printer, particularly a printing sheet feeding apparatus according to this invention.

Referring now to FIGS. 1 to 4, a color printer has a sheet feeding apparatus, generally indicated by a reference numeral 10, for feeding printing media, i.e., printing sheets or papers, one by one along a sheet feeding path located between a sheet supply unit 12 and a fuser 14. Along the sheet feeding path, four toner printing or transferring units 16Y, 16M, 16C, and 16B are arranged in series in the sheet feeding direction for transferring different color images of, e.g., yellow (Y), magenta (M), cyan (C), and black (B), respectively. Each of these toner printing units 16Y, 16M, 16C, and 16B has basically the same structure and operates in the same manner.

Each of the toner printing units 16Y, 16M, 16C, and 16B comprises a rotatable photoconductor drum **16*a* which rotates in the clockwise direction in FIG. 1, and around this photoconductor drum 16a and along the direction of rotation thereof, are arranged an charger unit 16b for charging the peripheral surface of the photoconductor drum 16a, an optical depositing unit including a LED array consisting of a number of light-emitting-diodes for exposing onto the surface of the photoconductor drum 16a to form a latent image on the charged surface of the photoconductor drum 16a, a toner developing unit 16d for attaching toner onto the latent image on the photoconductor drum 16a to form a toner image, a transfer/discharge unit 16e for transferring the toner image on the photoconductor drum 16a to a printing sheet P and then discharging the peripheral surface of the photoconductor drum 16a, and a cleaner 16f for removing the remaining toner from the photoconductor drum 16a**.

The transfer/discharge unit 16e comprises a pair of corotron units 16e $_1$ and 16e $_2$ operating as a transferring unit and a discharge unit, respectively. Namely, the transferring unit 16e $_1$ applies an electric charge opposite to that of the charged toner image, to the printing sheet P, so that the toner image on the surface of the photoconductor drum 16a is transferred to the printing sheet P. On the other hand, the discharge unit 16e $_2$ is energized with alternating current to remove the electric charge on the printing sheet P, to prevent the printing sheet P from becoming attached or flattened against the photoconductor drum 16a by the static charge, and to make it possible to easily separate the printing sheet P from the photoconductor drum 16a.

Figure 3:
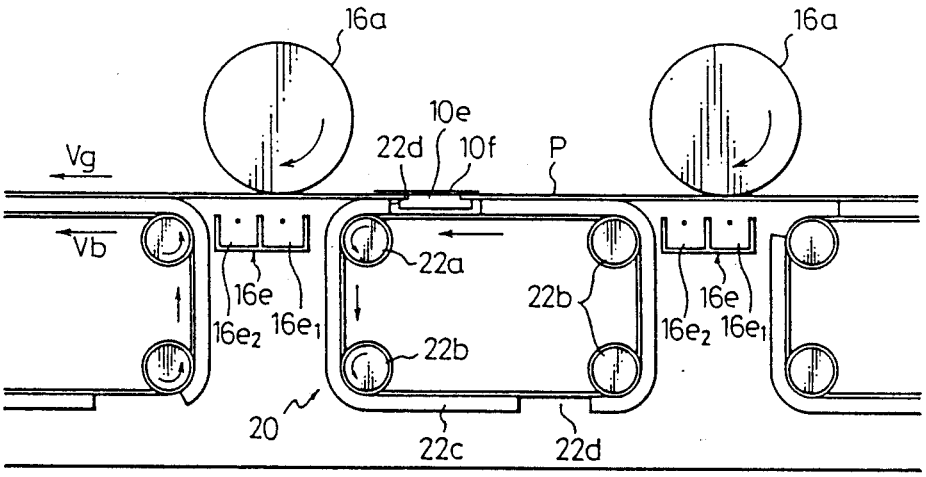
FIG. 3 is a partial front view of the sheet feeding apparatus of the color printer.

As shown in FIGS. 1 and 3, the transfer/discharge unit 16e comprising a pair of corotron units 16e $_1$ and 16e $_2$ is arranged opposite to the photoconductor drum 16a with respect to the sheet feeding path and, therefore, belt assemblies 20, as mentioned later, are arranged between the transfer/de-charger units 16e of the adjacent toner printing units 16.

Figure 2:
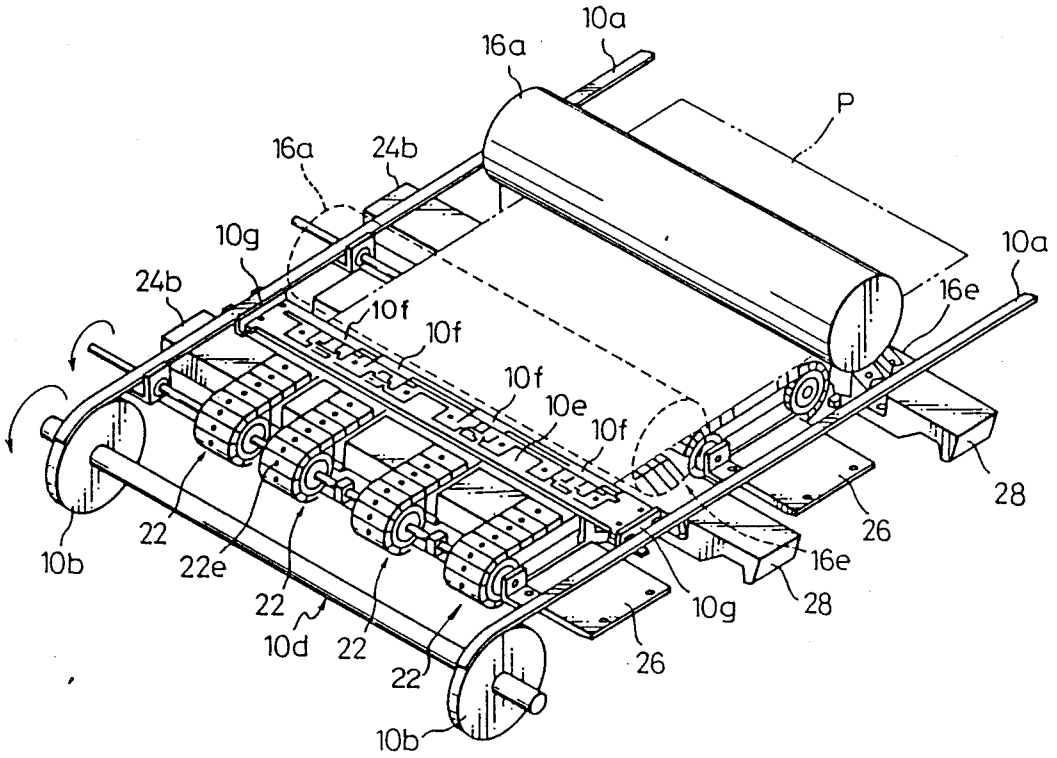
FIG. 2 is a partial perspective view of the sheet feeding apparatus shown in FIG. 1.

As shown in FIG. 2, the printing sheet feeding apparatus 10 comprises a pair of endless belts or chains 10a extended in parallel to each other from a pair of drive pulleys 10b supported on a transverse shaft 10d and a pair of driven pulleys 10c (FIG. 1). The endless belt 10a may be a toothed belt driven by a suitable drive means, not illustrated, via the transverse shaft 10d and the toothed drive pulley 10b.

Transverse plates 10e are mounted on and between the pair of endless belts 10a by mounts 10g attached to the respective ends of the transverse plate 10e, which are equidistantly arranged along the sheet feeding direction. Each of the transverse plates 10e is provided with four gripping pieces or grippers 10f spacedly arranged for cooperatively gripping a leading end of the printing sheet P. The gripper 10f is made of a thin piece pivotally mounted on the transverse plates 10e and always urged toward the transverse plates 10e by a spring means, not illustrated to hold a leading end of the printing sheet P therebetween. The operation of the gripper 10f will be described later in detail.

The sheet supply unit 12 comprises a hopper 12a for accommodating a stack of printing sheets P and a pickup roller 12b for picking up the printing sheets P one by one from the hopper 12a to supply the sheets P the sheet feeding apparatus. Therefore, when a printing sheet P is picked up by the pickup roller 12b, the leading end of the printing sheet P is gripped by the grippers 10f and then the printing sheet P is fed along the sheet feeding path to pass in turn, through the toner printing units 16Y, 16M, 16C, and 16B.

Namely, when the transverse plate 10e for carrying the grippers 10f for holding the printing sheet P is detected by a sensor 16g arranged in front of the first toner printing unit 16Y, operation of the LED array 16c of this unit 16Y is started so that a latent image is formed on the peripheral surface of the photoconductor drum 16a. The latent image is then changed to a charged toner image by the toner developing unit 16d. When the toner image on the photoconductor drum 16a arrives at the charger unit 16e $_1$, the leading end of the printing sheet P is introduced into the transfer unit 16e $_1$ and the toner image on the photoconductor drum 16a is transferred to the printing sheet P.

After the transferring operation is finished in the first toner printing unit 16Y and a color image of yellow is transferred onto the printing sheet P, the latter is then fed to the second toner printing unit 16M, in which the same operation is repeated, so that a color image of magenta is transferred onto the same printing sheet P. Namely, the toner images of different colors, i.e., yellow, magenta, cyan, and black are superimposed, in turn, on the printing sheet P.

Then the printing sheet P is released from the grippers 10f, as will be described later in detail, and fed into the fuser 14, where the transferred image on the printing sheet P is fixed. The fuser 14 comprises a pair of heat and backup rollers 14a and 14b between which the printing sheet P passes through and the toner image is fixed. Then, the printing sheet P is unloaded on a tray 18 and stacked thereon.

According to the present invention, a plurality of sheet support assemblies 20 are provided between the toner printing units 16Y, 16M, 16C, and 16B, as shown in FIG. 1, to support the printing sheet P and maintain a horizontal state thereof, to prevent a tailing end of the printing sheet P from dropping or trailing down, particularly when the printing sheet P passes between the toner printing units 16Y, 16M, 16C, and 16B.

In one embodiment, as shown in FIG. 2, each of the sheet support assemblies 20 comprises four endless belts assemblies 22 arranged in parallel to each other and between the above-mentioned pair of endless belts 10a. Each of the belts assemblies 22 comprises a drive timing pulley 22a, a driven pulley 22b, and an endless toothed timing belt 22c extended between these pulleys. These endless belts assemblies 22 are driven in synchronization with the above-mentioned pair of endless belts 10a, as will be described below.

In one embodiment, these belts assemblies 22 are driven in such a manner that the circumferential speed thereof is the same as that of the grippers 10f, i.e., the endless belts 10a. Also, the endless belt 22c has at least one recess 22d for receiving the transverse plate 10e carrying the grippers 10f. Thus, when the recess 22d comes to the upper path of this endless belt 22c, the transverse plate 10e is received in the recess 22d so that the upper path of the endless belt 22c can be located at the same level as the thin gripping pieces 10f, i.e., grippers 10f, and at the same level as the lower portion of the photoconductor drum 16a. Therefore, the printing sheet P can be supported on these endless belts 22c in an exact horizontal state and, therefore, the tailing end of the printing sheet P is not bent or deformed while moved along the feeding path.

FIG. 3 shows such an endless belt assembly 20 in more detail. In this embodiment, the endless belt 22c is extended over one drive pulley 22a and three driven pulleys 22b to form a substantially rectangular loop.

The endless belt 22c has one recess 22d for receiving the transverse plate 10e carrying the grippers 10f, and therefore, the circumferential length of the endless belt 22c is exactly equal to the distance between the adjacent transverse plates 10e (i.e., grippers 10f).

The distance between the adjacent grippers 10f should be determined so as to securely hold the printing sheet P; Namely, it should be larger than a maximum length of the printing sheet P. The endless belt 22c can be provided with one, two or more recesses 22d provided equidistantly along the circumferential direction of the endless belt 22c, but if the circumferential speed of the endless belt 22c is equal to the speed of the grippers, the circumferential length Lb of the endless belt 22c should be determined as $Lg \times n/m$, wherein Lg: a distance between the adjacent grippers 10f, n: number of recesses of the endless belt 22c, and m: an integral number.

Thus, in one embodiment, $n = 2$, and $m = 3$. In this case, while the grippers 10f move by one cycle or pitch, i.e., the subsequent grippers 10f move to positions at which the preceding grippers were located, the endless belt 22c is turned 1.5 times around the pulleys 22a and 22b. Note, the endless belt 22c is driven at the same speed as the grippers 10f.

In one embodiment, the circumferential speed of the endless belt 22c in the respective belt assembly 20 can be set to be less than the speed of the grippers, by a few or several percent. In this case, the endless belt 10a for carrying the grippers 10f and the endless belt 22c for supporting the printing sheet P should be driven as follows.

$$Tg = Lg/Vg = Lb/Vb \times m/n$$

$$Vg > Vb$$

provided that:

Tg: a feeding cycle of the gripper 10f,

Lg: a distance between adjacent grippers 10f,

Vg: a speed of the grippers,

Lb: a circumferential length of the endless belt 22c,

Vb: a circumferential speed of the endless belt 22c, n: a number of recesses of the endless belt 22c, and, m: an integral number.

According to this embodiment, while the printing sheet P is fed by the grippers 10f at a speed of Vg, a slight back tension is given to the printing sheet P by a friction force with respect to the endless belt 22c, since the speed of the latter (Vb) is slightly less than the gripper speed (Vg). Therefore, even if the printing sheet P is bent or deformed for any reason, the problem is automatically resolved and the printing sheet P returned to the original horizontal flat state.

Figure 4:
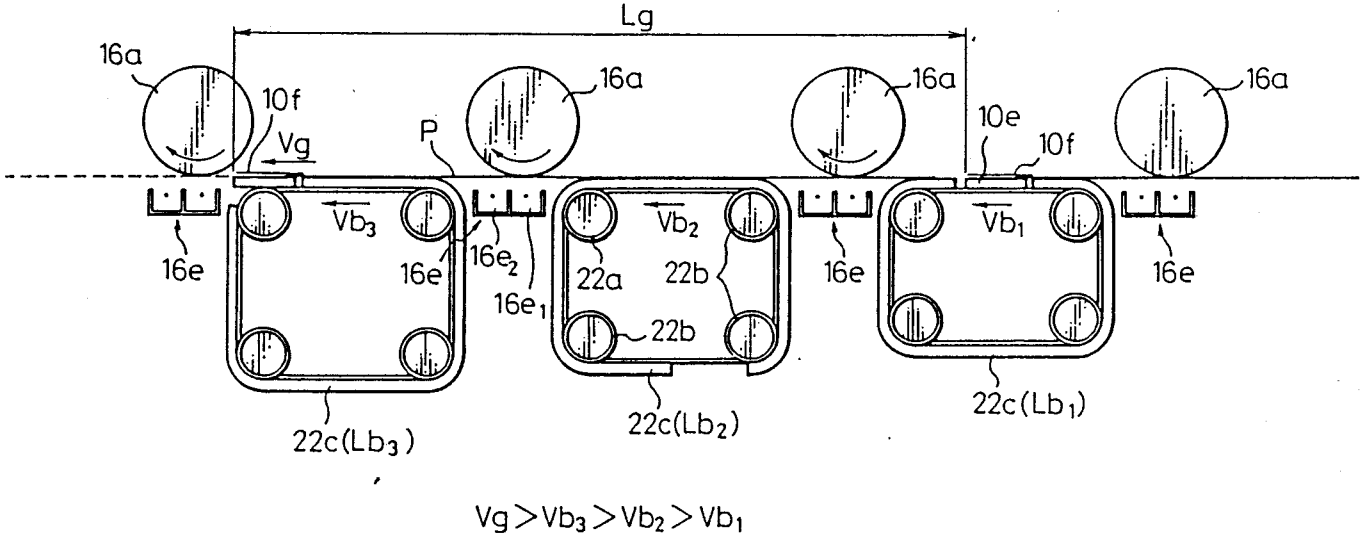
FIG. 4 is a view similar to FIG. 3 but illustrating another embodiment.

FIG. 4 shows another embodiment of the printing sheet feeding apparatus according to the present invention, in which the circumferential speeds of the endless belts 22c among the respective belt assemblies 20 are different. Namely, the endless belt 10a for carrying the grippers 10f and the endless belts 22c for supporting the printing sheet P are driven as follows.

$$Tg = Lg/Vg = Lb_1/Vb_1 \times ml/nl = Lb_2/Vb_2 \times m2/n2 = Lb_3/Vb_3 \times m3/n3, \text{ and } Vg > Vb_1 > Vb_2 > Vb_3$$

provided that:

Tg: a feeding cycle of the gripper 10f,

Lg: a distance between adjacent grippers 10f,

Vg: a speed of the grippers,

Lb: a circumferential length of the endless belt 22c,

Vb: a circumferential speed of the endless belt 22c, $Lb_1$, $Lb_2$, $Lb_3$circumferential lengths of the endless belt 22c from upstream to downstream along the sheet feeding path, $Vb_1$, $Vb_2$, $Vb_3$: circumferential speeds of the endless belt 22c from upstream to downstream along the sheet feeding path, n1, n2, n3: number of recesses of the endless belt 22c from upstream to downstream along the sheet feeding path, and m1, m2, m3: integral numbers.

In this embodiment, while the printing sheet P is fed by the grippers 10f at a speed of Vg, a slight back tension is given to the printing sheet P by a friction force with respect to the endless belts 22c, since the speeds of the latter ($Vb_1$, $Vb_2$, $Vb_3$) are slightly less than the gripper speed (Vg). In practical, $Vb_3$ is less than Vg by a few percent. In addition, $Vb_2$ is less than $Vb_3$ and $Vb_1$ is less than $Vb_2$, by a few percent, respectively, and therefore, such a back tension is also given to the printing sheet P between the respective belt assemblies 20. Therefore, even if the printing sheet P is bent or deformed for any reason, the printing sheet P is perfectly extended and returned exactly to the original horizontal flat state.

Figure 5A:
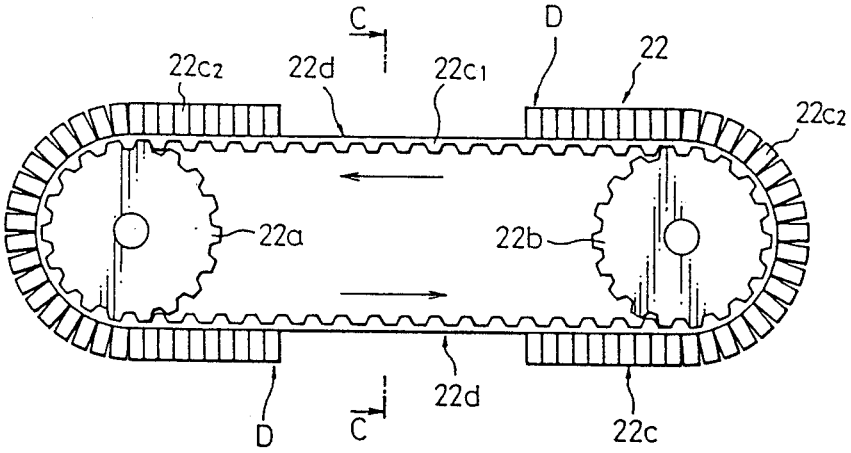
FIGS. 5A, 5B, and 5C are front, plan, and cross-sectional views, respectively, of an endless belt assembly for supporting a printing sheet.
Figure 5B:
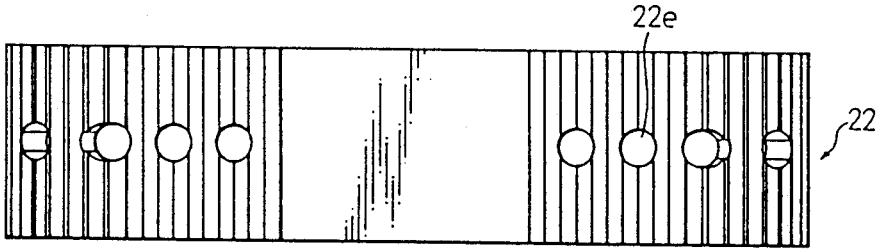
Figure 5C:
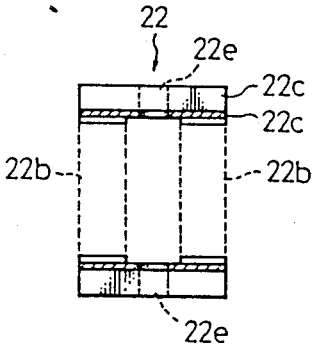
Figure 6:
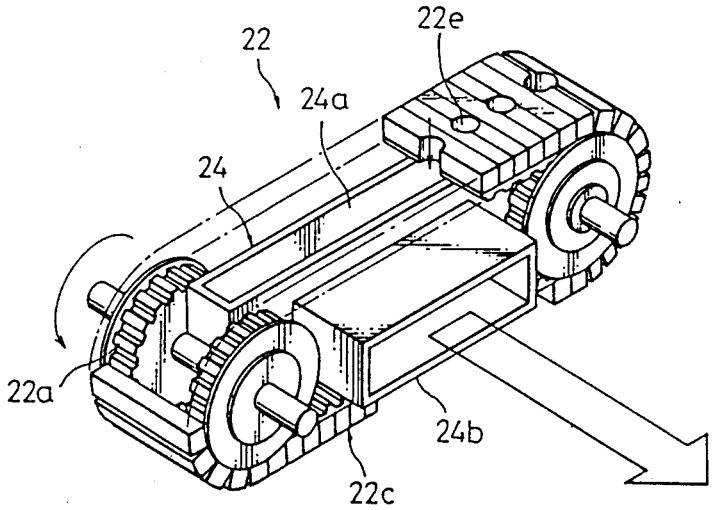
FIG. 6 is a perspective view of another embodiment of the endless belt assembly.

In FIGS. 5A, 5B, and 5C, the endless belt assembly 22 comprises a toothed timing drive pulley 22a, a toothed driven pulley 22b, and a toothed timing endless belt 22c extended therebetween. This endless belt 22c has two recesses 22d for receiving the grippers 10f. The endless belt 22c consists of a relatively thin base portion $22c_1$ made of a hard rubber material and provided with a plurality of teeth, to thereby constitute the timing belt, and a relatively thick peripheral portion $22c_2$ made of a relatively soft rubber material, such as sponge, adhered to the former portion. The thin portion $22c_1$, not having the thick portion 22c defines the above-mentioned two recesses 22d. The thick peripheral portion 22c is divided by a plurality of transverse cuts extending from the outer periphery thereof toward the thin base portion 22c , to form a plurality of cut sections $22c_2$.

These cut sections $22c_2$ make it possible to reduce stress imposed on this endless belt 22c when turning around the drive pulley 22a or the driven pulley 22b. If such cut sections, were not provided, an unfavorable excess stress would be exerted on the belt, particularly when the leading parts D (FIG. 5A) of the belt 22c 2 next to the recesses 22d reach the pulley 22a or 22b and start to turn therearound. In such a case, the speed of this endless belt 22c would become unstable. In this embodiment, however, when the endless belt 22c turns around the pulley 22a or 22b, the cut sections $22c_2$ are separated from each other and, therefore, the endless belt 22c turns more easily around the pulley 22a or 22b to reduce the stress exerted thereon.

The endless belt 22c is further provided with a plurality of air suction holes 22e arranged over an entire circumferential length of the belt 22c except for the recess portions 22d. Between the upper and lower paths of the endless belt 22c there is disposed a box-like air suction duct member 24 along the longitudinal or sheet feeding direction of the endless belt 22c. The member 24 has an upper opening 24a, which is communicated with the air suction holes 22e when they are at the upper path of the belt 22c, and a side air duct 24b connected to a vacuum source, such as a vacuum pump not shown. The printing sheet P can thus be absorbed and stably supported by the air suction force available over the upper path of the endless belt 22c, even if the photoconductor drum 16a is not completely de-charged by the transfer/discharge unit 16e, so that the printing sheet P is not subjected to a static electric charge.

Figure 7A:
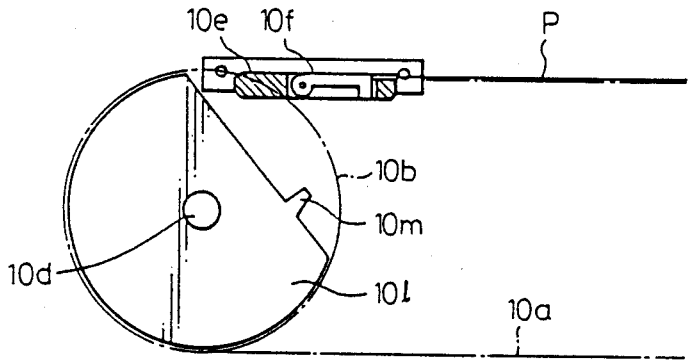
FIGS. 7A, 7B, and 7C are schematic views illustrating an operation of the gripper when releasing a printing sheet; and, FIGS. 8A, 8B, and 8C are views similar to FIGS. 7A, 7B, and 7C, respectively, but illustrating an operation of the gripper when picking up a printing sheet.
Figure 7B:
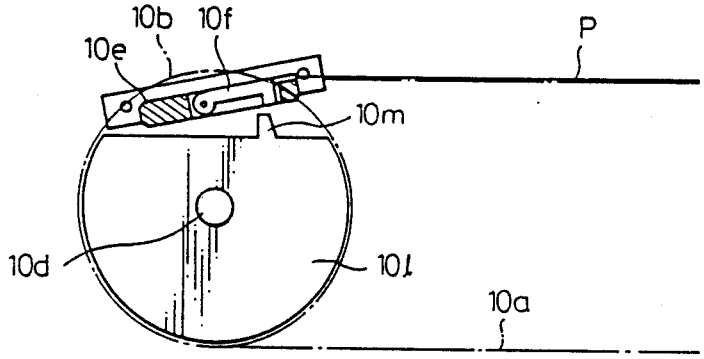
Figure 7C:
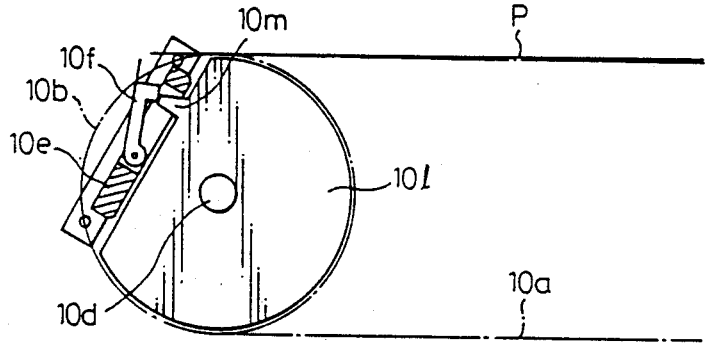

FIGS. 7A–C and 8A–C illustrate the operations of the grippers 10f for releasing and picking up the printing sheet P, respectively. As shown in FIGS. 7A–C, a drive shaft 10d on which the drive pulleys 10b are rigidly mounted is provided with a cam member 101 having a projection 10m. The drive shaft 10d is rotated in such a manner that the projection 10m cooperates with the gripper 10f. Namely, the transverse plate 10e for carrying the grippers 10f, which now hold the leading end of the printing sheet P, approaches the drive pulley 10b (FIG. 7A) and is then wound therearound (FIG. 7B). Then the projection 10m engages with the gripper 10f (FIG. 7C), so that the gripper 10f is pivotably moved against the spring means, not illustrated to release the leading end of the printing sheet P. When the transverse plate 10e comes away from the drive pulley 10b, the gripper 10f is returned to its initial position by the spring means.

Figure 8A:
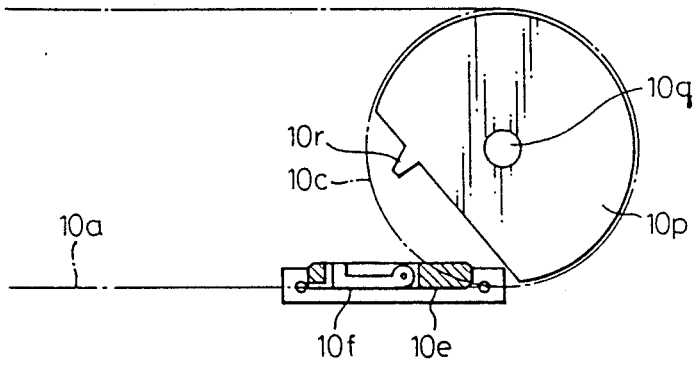
Figure 8B:
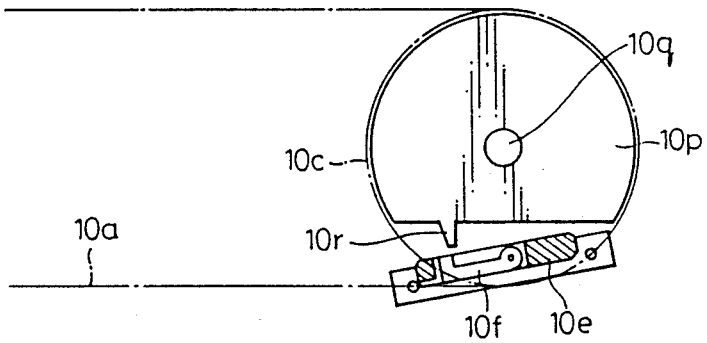
Figure 8C:
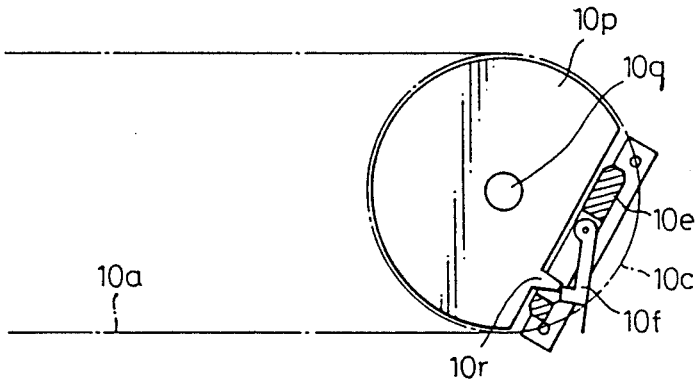

In FIGS. 8A–C, a driven shaft 10q on which the driven pulleys 10c are rigidly mounted is provided with a cam member 10p having a projection 10r, which cooperates with the gripper 10f, in the same manner as FIGS. 7A–C. Namely, the transverse plate 10e (the grippers 10f) approaches the driven pulley 10c (FIG. 8A) and then is wound therearound (FIG. 8B). Then the projection 10r engages with the gripper 10f (FIG. 8C), so that the gripper 10f is pivotably moved against the spring means to open, and at this time, the printing sheet P is picked up by the pickup roller 12b (FIG. 1) and the leading end of the printing sheet P is inserted between the gripper 10f and the transverse plate 10e. Then the projection 10r disengages from the gripper 10f, so that the leading end of the printing sheet P is gripped between the gripper 10f and the transverse plate 10e.

As mentioned above, according to the present invention, the printing sheet P is prevented from being bent or deformed while fed along the sheet feeding path, and therefore, an exact feeding and horizontal state of the printing sheet can be obtained, so that the transferring or printing positions of the printing sheet P always coincide in the respective toner printing units 16Y, 16M, 16C, and 16B, and thus the quality of the printing can be significantly improved.

As clearly understood from the above, the present invention is also be applied to a copying machine.

I claim:

1. An apparatus for feeding a sheet in an image forming apparatus comprising:

a first endless belt or chain assembly for carrying grippers equidistantly mounted thereon for gripping a leading edge of the sheet to feed same along a substantially horizontal sheet feeding path;

a plurality of toner image forming units arranged in series along said sheet feeding path so that when the sheet passes through each of said toner image forming units a toner image is transferred to the sheet;

a plurality of second belt assemblies, each arranged between said toner image forming units along said sheet feeding path and comprising at least one second endless belt having a substantially horizontal sheet feeding portion, which is located at substantially the same level as said grippers, for supporting the printing sheet in a substantially horizontal state thereof; and said second endless belt having at least one recess for receiving said gripper.

2. An apparatus as claimed in claim 1, wherein said first and second endless belt assemblies are driven as:

$$Tg = Lg/Vg = Lbi/Vbi \times mi/ni$$

provided that:

Tg: a gripper feeding cycle,

Lg: a distance between adjacent grippers,

Vg: a circumferential speed of the first belt assembly

Lbi: circumferential length of the second belt assembly

Vbi: circumferential speed of the second belt assembly ni: number of recesses in the second endless belt, and mi: an integral number, provided that i = 1, 2, 3, . . . , k, in which k refers to a maximum number of second belt assemblies, and i refers to a number of order for the second belt assembly from upstream to downstream along the sheet feeding path.

3. An apparatus as claimed in claim 2, wherein said first and second belt assemblies are driven as:

$$Vg \geqq Vbk \geqq \ldots \geqq Vbi \geqq \ldots \geqq Vb3 \geqq Vb2 \geqq Vb1$$

4. An apparatus as claimed in claim 1, wherein said first endless belt assembly comprises a pair of first endless belts arranged in parallel to each other, and each of said grippers is transversely arranged and has respective ends thereof connected to said pair of first endless belts, respectively.

5. An apparatus as claimed in claim 4, wherein each of said grippers comprises a transverse plate and a plurality of thin gripping pieces each pivotably mounted on said transverse plate and urged thereto by spring means, so that the leading end of the printing sheet is gripped between said gripping pieces and said transverse plate.

6. An apparatus as claimed in claim 5, wherein said gripping pieces are pivotably moved to and from said transverse plate to grip and release the printing sheet at an inlet and an outlet, respectively, of said horizontal sheet feeding path.

7. An apparatus as claimed in claim 4, wherein each of said first endless belts is a toothed belt.

8. An apparatus as claimed in claim 4, wherein said second belt assemblies are arranged between said pair of first endless belts.

9. An apparatus as claimed 1, wherein said plurality of toner image forming units jcomprise four such units which are used for transferring, in turn, color images of yellow (Y), magenta (M), cyan (C), and black (B), respectively, to the printing sheet.

10. An apparatus as claimed in claim 1, wherein each of said toner image forming units includes a rotatable photoconductor drum, an charger unit for charging said photoconductor drum, an optical unit for forming a latent image on said photoconductor drum, a developing unit for changing said latent image to a toner image, a transferring unit for transferring said toner image on said photoconductor drum onto the printing sheet, and a cleaner for removing remaining toner from said photoconductor drum.

11. An apparatus as claimed in claim 10, wherein said charger unit, said optical unit, said developing unit, said transferring unit, and said cleaner are arranged in turn along a periphery of said photoconductor drum.

12. An apparatus as claimed in claim 11, wherein said transferring unit is arranged opposite to said photoconductor drum with respect to the sheet feeding path and said second belt assemblies are arranged between said transferring units of the adjacent toner image forming units.

13. An apparatus as claimed in claim 1, wherein each of said second belt assemblies comprises a plurality of second endless belts arranged in parallel to each other and in parallel to said first endless belt assembly.

14. An apparatus as claimed in claim 1, wherein said second endless belt is a toothed belt.

15. An apparatus as claimed in claim 1, wherein said second endless belt is provided on the outer circumferential periphery thereof with a plurality of transverse cut sections over an entire circumferential length thereof except for said at least one recess.

16. An apparatus as claimed in claim 1, wherein said second endless belt is provided on the outer circumferential periphery thereof with a plurality of vacuum absorbing means for absorbing the printing sheet to said second endless belt.

17. An apparatus as claimed in claim 16, wherein said vacuum absorbing means comprises a plurality of air holes arranged over an entire circumferential length thereof except for said at least one recess.

* * * * *